US008265311B2

(12) United States Patent
Edgar

(10) Patent No.: US 8,265,311 B2
(45) Date of Patent: Sep. 11, 2012

(54) METHOD AND APPARATUS FOR USING TEXT MESSAGES TO DISTRIBUTE RING TONES TO ADJUST HEARING AIDS

(75) Inventor: Dan Edgar, Lakeville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 515 days.

(21) Appl. No.: 12/577,499

(22) Filed: Oct. 12, 2009

(65) Prior Publication Data

US 2011/0085687 A1 Apr. 14, 2011

(51) Int. Cl.
*H04R 25/00* (2006.01)
*H04R 29/00* (2006.01)

(52) U.S. Cl. ..... 381/315; 381/314; 381/60

(58) Field of Classification Search ..... 381/312, 381/314, 315, 23.1, 58, 60; 455/556.1, 556.2, 455/567, 3.06, 412.1
See application file for complete search history.

(56) References Cited

U.S. PATENT DOCUMENTS

| | | | | |
|---|---|---|---|---|
| 5,083,312 | A | 1/1992 | Newton et al. | |
| 6,115,478 | A | 9/2000 | Schneider | |
| 2007/0255435 | A1 * | 11/2007 | Cohen et al. | 700/94 |
| 2007/0269067 | A1 * | 11/2007 | Aschoff et al. | 381/317 |

* cited by examiner

*Primary Examiner* — Tuan Nguyen
(74) *Attorney, Agent, or Firm* — Schwegman, Lundberg & Woessner, P.A.

(57) ABSTRACT

The present subject matter relates generally to methods and apparatus for using text messages to distribute ring tones to adjust and fit hearing assistance devices. In an embodiment, a text message is programmed including information regarding a hearing assistance device adjustment for a wearer. The text message identifies a ring tone playback sequence associated with the adjustment, and is sent to a cellular telephone via a text messaging network. When the ring tone playback sequence is played on the cellular telephone, the hearing assistance device senses the sequence and makes the programmed adjustment.

20 Claims, 3 Drawing Sheets

METHOD AND APPARATUS FOR USING TEXT MESSAGES TO DISTRIBUTE RING TONES TO ADJUST HEARING AIDS

FIELD OF THE INVENTION

The present subject matter relates generally to adjusting and fitting hearing aids, and in particular to methods and apparatus for using cellular telephone text messages to distribute ring tones to adjust and fit hearing aids.

BACKGROUND

Wearers of hearing aids undergo a process called "fitting" to adjust the hearing assistance device to their particular hearing and use. In such fitting sessions the wearer may select one setting over another, much like selecting one setting over another setting in an eye test. Other types of selections include changes in level, which can be a preferred level by the subject. After the initial fitting process, a wearer may desire further adjustments of hearing assistance devices to further tune the device and/or to match different acoustic environments.

There is a need in the art for an improved method and apparatus for adjusting and fitting hearing aids.

SUMMARY

Disclosed herein, among other things, are methods and apparatus for using text messages to distribute ring tones to adjust and fit hearing assistance devices. The present subject matter provides for the application of cellular telephone technology to hearing aid adjusting and fitting system software. In an embodiment, a text message is programmed including information regarding a hearing assistance device adjustment for a wearer. The text message identifies a ring tone playback sequence associated with the adjustment. The text message is sent to the wearer's cellular telephone. The adjustment is made to the hearing assistance device when the device senses the ring tone playback sequence is played on the cellular telephone.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
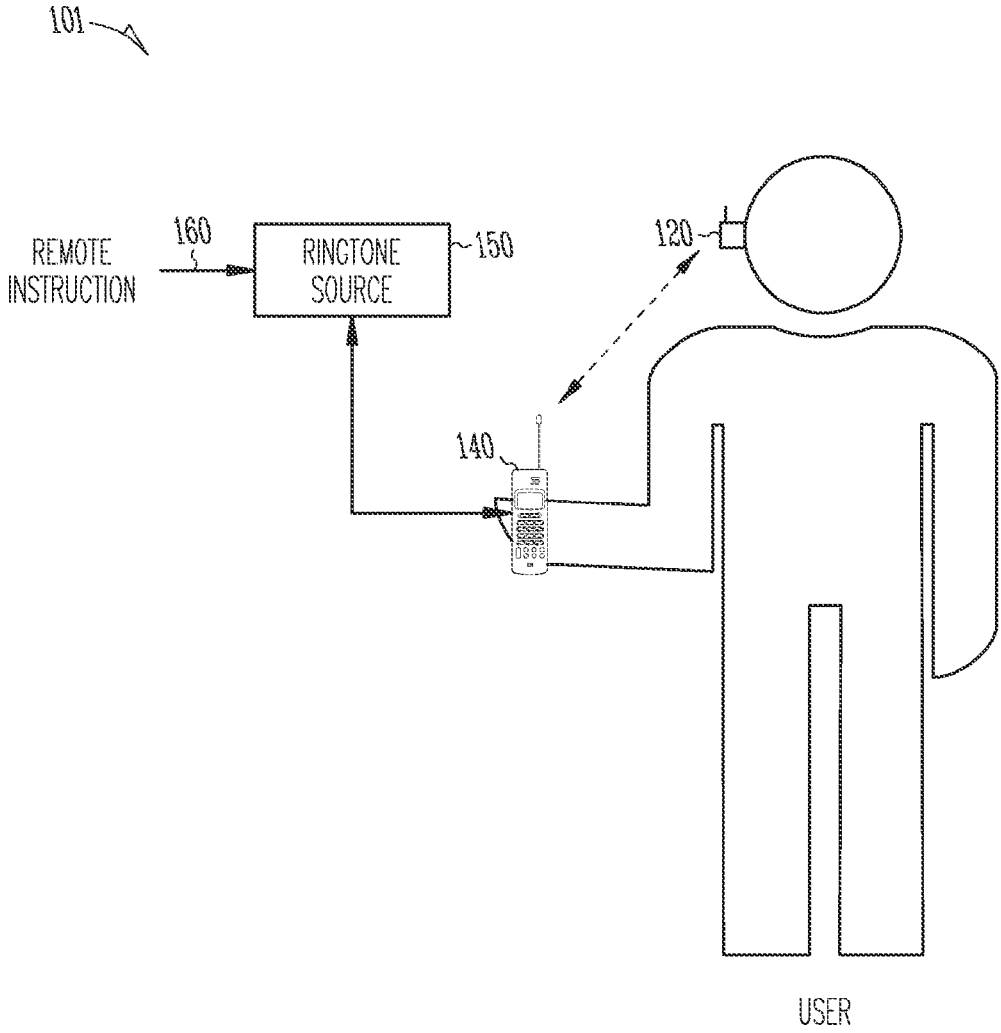
FIG. 1A shows a system for providing ringtones to a cellular telephone, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

In many developing countries, the use of cellular telephones greatly outpaces the use of personal computers. Because of factors such as cost and availability, cellular telephones are the first "computer" to which much of the world's population is exposed. In addition, the training that people need to use a personal computer is greater than the training that people need to use a cellular telephone. In the hearing aid industry, a solution is needed for adjusting hearing aids in remote places or for wearers who do not have a personal computer. A cellular telephone can be turned into a powerful device for the delivery of telemedicine for hearing aid technologies.

The present subject matter relates generally to methods and apparatus for using text messages to control hearing assistance devices. In various embodiments, different sources may provide an instruction to control the hearing assistance device. For example, the wearer of a hearing assistance device, such as a hearing aid, enters an instruction into the wearer's cellular telephone and ring tone and/or a series of ring tones is provided to the cellular phone that can be recognized by the hearing assistance device (e.g., hearing aid) for control of the hearing assistance device. In various embodiments, the instruction is received from a remote source. In various embodiments, the instruction is sent to a ringtone source, such as a remote database, translator, lookup table, computer or other storage mechanism, and converted into information identifying the proper ringtone and/or ringtone sequence recognizable by the hearing assistance device for controlling the hearing assistance device. In various embodiments, the ringtone source has downloaded the appropriate conversion information to the cellular phone to convert the instruction into a proper ringtone and/or ringtone sequence recognizable by the hearing assistance device. In various embodiments, the cellular phone has a lookup table for each instruction to properly convert it into the corresponding ringtone and/or ringtone sequence. In various embodiments, the instruction is formed as a text message to be sent to a remote location to obtain ring tone information used to control the hearing assistance device. In various embodiments, the ring tone information is used to adjust and fit hearing assistance devices. In an embodiment, a text message is programmed including information regarding a hearing assistance device adjustment for a wearer. The text message identifies a ring tone playback sequence associated with the adjustment, and is sent to the wearer's cellular telephone via a text messaging network. When the ring tone playback sequence is played on the cellular telephone, the hearing assistance device senses the sequence and makes the programmed adjustment, according to various embodiments.

This present subject matter enables an integrated telemedicine scenario via cellular telephone that allows professionals sitting anywhere in the world to assist anyone with access to a cellular telephone and the text messaging system.

In various embodiments, the present subject matter provides for the use of the SMS messaging system, automated SMS agents, and ring tone delivery via the SMS messaging system to act as a telemedicine provider for hearing aid adjustments. Short Message Service (SMS) is a communication service using standardized communications protocols allowing the interchange of short text messages between mobile telephone devices. SMS text messaging is the most widely used data application on the planet, with 2.4 billion active users, or 74% of all mobile phone subscribers sending and receiving text messages on their phones. The SMS technology has facilitated the development and growth of text messaging. The connection between the phenomenon of text messaging and the underlying technology is so great that in parts of the world the term "SMS" is used as a synonym for a text message or the act of sending a text message, even when a different protocol is being used. SMS text messages can be managed and created by combining a standard mobile phone and a personal computer.

Formats for ring tones include MIDI, MP3, RTTTF, and others. All of these formats support dynamic and data driven creation which can be used by this system via the text messaging system to deliver ring tones.

RTTTF stands for Ring Tone Text Transfer Format. It was developed to be used to transfer cellular telephone ring tones. The RTTTF format is a string divided into three sections: name, default value, and data. The name section consists of a string describing the name of the ring tone. This can be no longer than 10 characters, and cannot contain a ":" character. The default value section is a set of values separated by commas, where each value contains a key and a value separated by an = character, which describes certain defaults which should be adhered to during the execution of the ring tone. Examples include Duration, Octave, and Beat/Tempo. RTTTF is a fully dynamic specification that can specify notes, duration, and timing of the ring tone in a very specific way via standard text.

MPEG-1 Audio Layer 3, more commonly referred to as MP3, is a digital audio encoding format using a form of lossy data compression. It is a common audio format for consumer audio storage, as well as a de facto standard of digital audio compression for the transfer and playback of music on digital audio players.

MIDI (Musical Instrument Digital Interface) is an industry-standard protocol that enables electronic musical instruments such as keyboard controllers, computers, and other electronic equipment to communicate, control, and synchronize with each other. MIDI allows computers, synthesizers, MIDI controllers, sound cards, samplers and drum machines to control one another, and to exchange system data. MIDI does not transmit an audio signal or media—it transmits "event messages" such as the pitch and intensity of musical notes to play, control signals for parameters such as volume, vibrato and panning, cues, and clock signals to set the tempo.

Dual-tone multi-frequency (DTMF) signaling is used for telecommunication signaling over analog telephone lines in the voice-frequency band between telephone handsets and other communications devices and the switching center. While DTMF tone based hearing aid adjustments have been proposed, the DTMF tone based system has issues involving usability and cell phone support. Namely, a patient has to keep the cell phone near their face and press number buttons to adjust their hearing aids. Also, the patient has to remember what buttons do what to their hearing aid. In addition, only one command can be issued for each of 12 buttons on the phone. Finally, not all cell phones play the standard DTMF tones when the number buttons are pressed. Thus, ring tone based telemedicine systems are preferred. For example, a ring tone based system allows a user to pick from many different possible adjustments from a central list of named ring tones.

According to various embodiments, the present subject matter utilizes a text messaging network (such as an SMS network), a bridge from a programming computer to the text messaging network, in combination with ring tones (such as RTTTF format) to deliver a series of recognizable tones to a hearing aid to adjust the response and/or fitting of the hearing aid to assist the patient in hearing scenarios via text messaging. Hearing aids have on board digital signal processors (DSP) that can be made to listen for specific tone combinations that can be created by RTTTF and adjust the hearing aid in a custom way depending on the tone duration or combination. This system allows telemedicine practices to be applied to the world of hearing aids in the remotest of locations.

In one example, a professional in the United States receives a complaint from a patient in India that his or her hearing aids are feeding back in certain situations. The professional in the United States makes a certain set of corrections to the fitting session on a computer. These corrections are turned into RTTTF tone playback sequences, and placed onto a SMS text messaging server. The patient receives a SMS text message: "To fix your hearing aids respond to this message with the text: 'fix'." The patient sends the SMS message: "fix" in response. The RTTTF ring tone is downloaded to the phone with the name "Fix Hearing Aids 1." The patient goes to their ring tone list and plays the ring tone. The hearing aid listens to the tone sequence and makes the required adjustments.

According to various embodiments, the ring tone can be repeated as needed and include a silence gap. This gives the patient time to start playing the ring tone, and then the patient can move the cell phone to the ear where they want to make the adjustment. The ring tone can string together a series of commands to make adjustment to the hearing aid. A hearing professional can run a hearing aid fitting system on the same computer that can send and receive text messages. If the fitting system is on the same computer as the text messaging, then the fitting system can save customized ring tones for a specific patient complaint, and engage the patient via text messaging to address specific complaints. Certain canned adjustments can exist on the computer, such as EchoDown, MakeLouder and MakeSofter.

FIG. 1A shows a system 101 for providing ringtones to a cellular telephone, according to various embodiments of the present subject matter. In various embodiments, the wearer of a hearing assistance device 120, such as a hearing aid, enters an instruction into a cellular telephone 140 and ring tone and/or a series of ring tones are identified and provided to the cellular phone that can be recognized by the hearing assistance device 120 (e.g., hearing aid) for control of the hearing assistance device 120. In various embodiments, the instruction arises from a remote source 160. Ringtone source 150 is used to identify a ringtone or a sequence of ringtones to perform a desired function. In various embodiments, ringtone source 150 is a remote database. In various embodiments, ringtone source 150 is a lookup table. In various embodiments, ringtone source 150 is a translator. In various embodiments ringtone source 150 is a computer. In various embodiments, ringtone source 150 is a computer executing hearing aid fitting software. In various embodiments, ringtone source 150 is another storage mechanism. In various embodiments, the ringtone source 150 has downloaded the appropriate conversion information to the cellular phone 140 to convert the instruction into a proper ringtone and/or ringtone sequence recognizable by the hearing assistance device 120. In various embodiments, the cellular phone 120 has a lookup table for each instruction to properly convert it into the corresponding ringtone and/or ringtone sequence. In various embodiments, the instruction is formed as a text message to from a remote location, such as ringtone source 150, to identify ring tone information used to control the hearing assistance device 120. In various embodiments, the ring tone information is used to adjust and fit hearing assistance devices. In an embodiment, a text message is programmed including information regarding a hearing assistance device adjustment for a wearer. The text message identifies a ring tone playback sequence associated with the adjustment, and is sent to the wearer's cellular telephone via a text messaging network. When the ring tone playback sequence is played by the cellular telephone, the hearing assistance device senses the sequence and makes the programmed adjustment, according to various embodiments. Thus, using ringtone source 150 it is possible in various embodiments to have translation that is remote from the cellular telephone and translation that is native to the cellular telephone. Other approaches are possible without departing from the scope of the present subject matter.

Figure 1B:
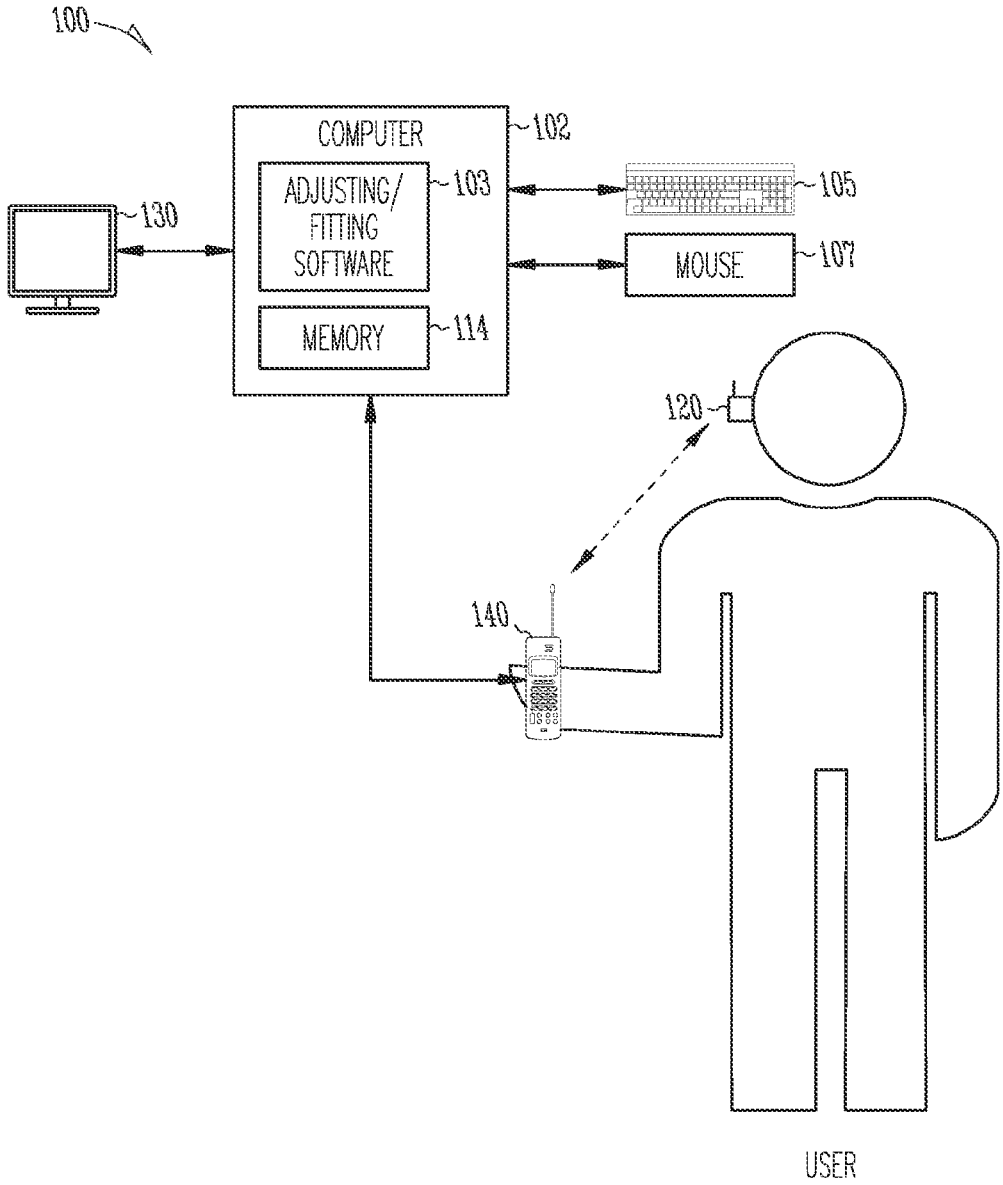
FIG. 1B shows an adjusting or fitting system for a hearing assistance device using a cellular telephone, according to various embodiments of the present subject matter.

FIG. 1B shows an adjusting and/or fitting system 100 for a hearing assistance device using a cellular telephone, according to various embodiments of the present subject matter. Computer 102 is adapted to execute adjusting/fitting software 103 that takes typical inputs from devices such as keyboard 105 and mouse 107 for adjusting/fitting one or more hearing assistance device 120. The present subject matter displays options for adjusting parameters on a computer screen 130, in various embodiments. It is understood that the user may be the wearer of one or more hearing aids or can be a clinician, audiologist or other attendant assisting with the use of the adjusting/fitting system 100. The system 100 includes memory 114 which stores and displays on display 130 one or more user selections for the fitting system. The computer 102 communicates with the wearer's cellular telephone 140 via a text messaging network, in various embodiments. As previously indicated, a text message includes information identifying a ring tone to be played on the cellular telephone. The hearing assistance device 120 senses the ring tone played on the cellular telephone 140, and makes a programmed parameter setting adjustment corresponding to the played ring tone. It is understood that the configuration shown in FIG. 1 is demonstrative and is not intended in an exhaustive or exclusive sense. Other configurations may exist without departing from the scope of the present subject matter. For example, it is possible that the memory 114 may be encoded in firmware, software, or combinations thereof. It is possible that the system may omit a mouse or a keyboard or may include additional input/output devices without departing from the scope of the present subject matter. Other variations are possible without departing from the present subject matter.

One aspect of the present subject matter includes a system for adjusting a hearing assistance device using cellular telephone text messaging. The system for adjusting a hearing assistance device worn by a wearer having a cellular telephone is executed on a computer, in various embodiments. The system includes an interface for entries of parameter settings of the hearing assistance device and memory to store the settings, in various embodiments. A processor is adapted to program a text message. The message identifies a ring tone playback sequence associated with the settings, and the processor is adapted to send the text message to the wearer's cellular telephone. According to various embodiments, the hearing assistance device is adapted to adjust to the settings when the device senses the ring tone playback sequence is played on the cellular telephone. The text message includes a short message service (SMS) text message, in an embodiment. The interface is adapted to provide a list of hearing assistance device adjustments for user selection, and the list includes an adjustment to decrease echo, an adjustment to decrease loudness, and an adjustment to increase loudness, in various embodiments. Other device adjustments can be included without departing from the scope of the present subject matter. The ring tone playback sequence is associated with multiple settings adjustments, in an embodiment.

The present subject matter includes a method for adjusting a hearing assistance device using cellular telephone text messaging. The method includes providing a text message to the wearer's cellular phone, the text message including information identifying a ring tone playback associated with hearing assistance device adjustment. In various embodiments, the present subject matter includes standard (or general) instruction tones and custom instruction tones. Custom instruction tones refer to ring tones generated by the present system when interfacing to a hearing aid fitting system software. In that embodiment, the fitting system serves as a shortcut to generate a custom tone sequence. For example, a medical provider makes adjustments to hearing aid parameters using fitting software, and would have an option to "send changes via RTTTF" to the patient. In various embodiments, standard instruction tones are generated by the present system. Standard instruction tones perform standard adjustments (i.e. volume up/volume down) and would not need to interface to a fitting system or fitting system software to make these adjustments. In various embodiments, a processor or look up table is used to perform standard adjustments.

One aspect of the present subject matter includes a method of adjusting a hearing assistance device using cellular telephone text messaging. In an embodiment, a text message is programmed including information regarding a hearing assistance device adjustment for a wearer. The text message identifies a ring tone playback sequence associated with the adjustment. The text message is sent to the wearer's cellular telephone. The adjustment is made to the hearing assistance device when the device senses the ring tone playback sequence is played on the cellular telephone. According to various embodiments, the text message is programmed as a short message service (SMS) text message. The text message is programmed on a personal computer, and hearing aid fitting software is executed on the computer, in various embodiments. Various ring tone formats can be used without departing from the scope of this disclosure. Examples include ring tone text transfer format (RTTTF), musical instrument digital interface (MIDI) and MPEG 1 audio layer 3 (MP3) sequences. According to various embodiments, the method further includes receiving a request from the wearer via an incoming text message for a hearing assistance device adjustment.

Figure 2:
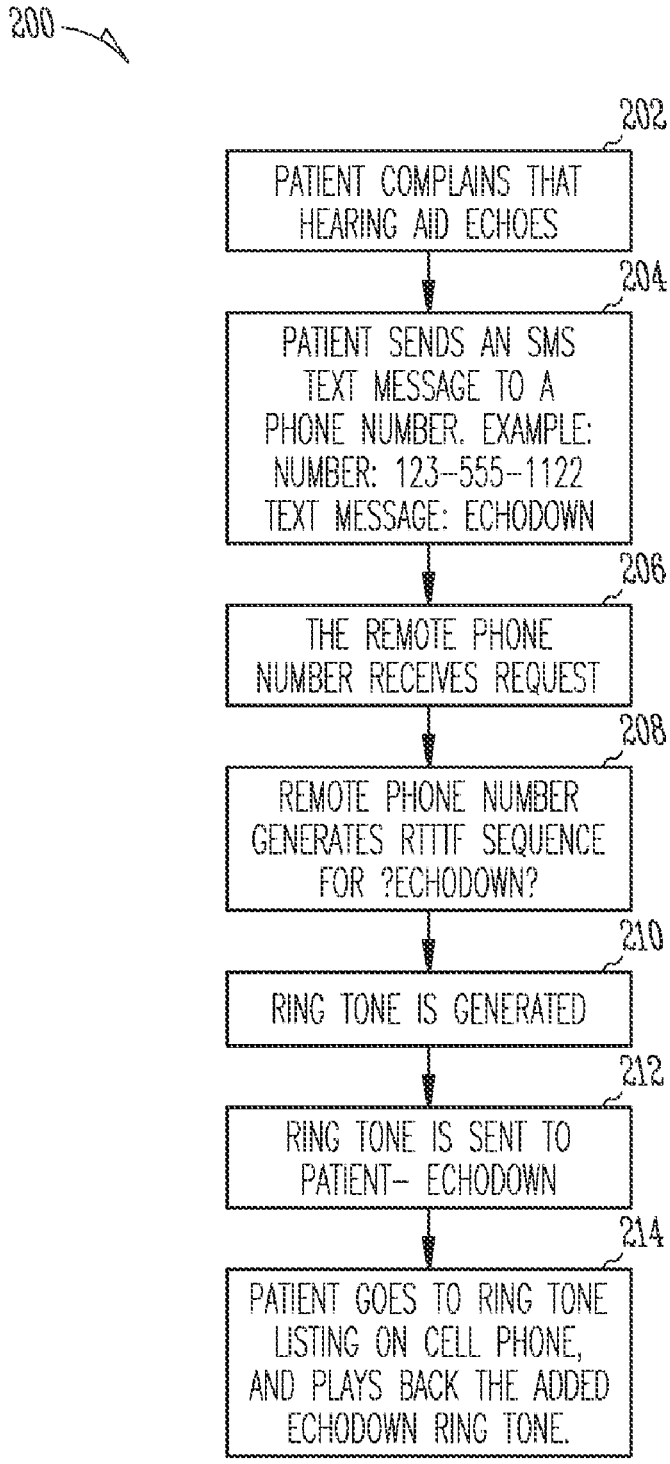
FIG. 2 illustrates a method of adjusting a hearing assistance device using cellular telephone text messaging, according to various embodiments of the present subject matter.

FIG. 2 illustrates a method of adjusting a hearing assistance device using cellular telephone text messaging, according to various embodiments of the present subject matter. At 202, a patient (or wearer) experiences a problem with his or her hearing assistance device. In the present example, the patient complains of an echo with the device. The patient sends a text message to a provider or clinician (or other third party) to inform them of the problem, at 204. The text message is received at 206, and a ring tone sequence is generated at 208. The generated ring tone sequence corresponds to a programmed parameter setting adjustment for the hearing assistance device. In the present embodiment, the ring tone sequence corresponds to an "EchoDown" device adjustment. At 210, the ring tone is generated, and the ring tone is sent via the text messaging network to the patient's cellular telephone at 212. At 214, the patient goes to the ring tone listing on cellular telephone, and plays the ring tone. The hearing assistance device senses the ring tone, and makes the corresponding adjustment, according to various embodiments. In the depicted embodiment, an SMS text messaging protocol is used and the ring tone is provided in RTTTF format.

In various embodiments, the hearing assistance device is programmed to receive and decode the ring tones and provide the associated instruction to the hearing assistance device. In the example of hearing aids, the digital signal processor of a hearing aid is programmable to perform tone detection to detect an encoded ringtone and/or ringtone sequence and then associate the detected tone with an intended control operation. In various embodiments, the digital signal processor looks for a predetermined tone sequence in the ringtone. In various embodiments, a Goertzel algorithm is used for tone detection. Various tone detection algorithms are possible, including those known in the art, without departing from the scope of the present subject matter. In various embodiments, the data transferred includes a preamble tone or tone sequence. The preamble can be followed by data or other control information. Thus, several encoding practices are possible without departing from the scope of the present subject matter.

Further uses of cellular telephone text messaging for fitting hearing aids and entering hearing aid clinical data are within the scope of the present subject matter. As described, applying cellular telephone text messaging and ring tone playback to adjust hearing assistance device parameter settings has many clinically meaningful uses.

In various embodiments, a network connection is used to transmit or receive information for fitting or adjusting the hearing assistance device. In various embodiments, the INTERNET is used to communicate information for the fitting. In various embodiments a wireless connection is used to communicate information for the fitting.

The present subject matter is demonstrated in the fitting of hearing aids, including but not limited to, behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. The present subject matter can also be used in hearing assistance devices generally, such as cochlear implant type hearing devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for adjusting a parameter setting of a hearing assistance device worn by a wearer using a cellular telephone, comprising:

detecting a ring tone played by the cellular telephone using the hearing assistance device, the ring tone associated with a hearing assistance device adjustment; and performing the hearing assistance device adjustment.

2. The method of claim 1, further comprising:

generating information identifying the ring tone associated with the hearing assistance device adjustment for use in a text message.

3. The method of claim 2, wherein the text message includes a short message service (SMS) text message.

4. The method of claim 2, wherein the generating information includes receiving information from a computer executing hearing aid fitting system software.

5. The method of claim 4, further comprises interfacing the computer with an SMS text messaging network.

6. The method of claim 2, further comprising placing the information identifying the ring tone on an SMS text messaging server.

7. The method of claim 2, wherein the information identifying the ring tone includes a ring tone text transfer format (RTTTF) sequence.

8. The method of claim 2, wherein the information identifying the ring tone includes a musical instrument digital interface (MIDI) sequence.

9. The method of claim 2, wherein the information identifying ring tone includes a MPEG1 audio layer 3 (MP3) sequence.

10. The method of claim 1, further comprising receiving a request from the wearer for the hearing assistance device adjustment.

11. The method of claim 10, wherein receiving a request from the wearer includes receiving a text message from the wearer.

12. The method of claim 1, wherein the hearing assistance device is a hearing aid.

13. A system for adjusting a hearing aid worn by a wearer using a cellular telephone, comprising:

an interface to enter one or more settings of the hearing aid;

memory to store the one or more settings; and a processor adapted to associate a text message with a ring tone sequence for each of the one or more settings to distinctly identify each setting.

14. The system of claim 13, wherein the text message includes a short message service (SMS) text message.

15. The system of claim 13, wherein the interface is adapted to provide a list of hearing aid adjustments for wearer selection.

16. The system of claim 15, wherein the list of hearing aid adjustments includes an adjustment to decrease echo.

17. The system of claim 15, wherein the list of hearing aid adjustments includes an adjustment to decrease loudness.

18. The system of claim 15, wherein the list of hearing aid adjustments includes an adjustment to increase loudness.

19. The system of claim 13, wherein the ring tone sequence is programmable with multiple setting adjustments.

20. The system of claim 13, wherein the ring tone sequence includes a ring tone text transfer format (RTTTF) sequence.

* * * * *